US006393789B1

(12) United States Patent
Lanclos

(10) Patent No.: US 6,393,789 B1
(45) Date of Patent: May 28, 2002

(54) REFRACTORY ANCHOR

(76) Inventor: Christopher P. Lanclos, 2391 Golden Shores, League City, TX (US) 77573

( * ) Notice: Subject to any disclaimer, the term of this patent is extended or adjusted under 35 U.S.C. 154(b) by 0 days.

(21) Appl. No.: 09/614,813

(22) Filed: Jul. 12, 2000

(51) Int. Cl.[7] ..... B04B 1/24

(52) U.S. Cl. ..... 52/378; 52/334; 52/443; 52/506.02; 52/747.13; 110/338

(58) Field of Search ..... 52/334–337, 344, 52/348, 378, 513, 514, 353, 360, 714, 506.02, 396.01, 443, 747.13; D8/384; 432/118, 119; 110/338–339

(56) References Cited

U.S. PATENT DOCUMENTS 1,962,906 A * 6/1934 Mueller ..... 52/334 X
4,479,337 A 10/1984 Crowley
4,581,867 A 4/1986 Crowley
4,651,487 A 3/1987 Nishikawa
4,660,343 A 4/1987 Raycher et al.
4,680,908 A 7/1987 Crowley
4,711,186 A 12/1987 Chen et al.
4,753,053 A 6/1988 Heard
D375,892 S * 11/1996 Kraemer, Jr. ..... D8/384
D393,588 S * 4/1998 Tuthill ..... D8/384

* cited by examiner

*Primary Examiner*—Carl D. Friedman
*Assistant Examiner*—Winnie Yip
(74) *Attorney, Agent, or Firm*—Keeling Law Firm

(57) ABSTRACT

A refractory anchor and method of use. The anchor is made by combining two similar sections that are clinched together to form an elongated X-shape. The bilateral symmetrical shape affords maximum anchorage of the refractory, and through-flow of the refractory is afforded by voids through the anchor. The anchor has feet that attach to the surface to be protected, thus allowing refractory to migrate under the anchor. The similar sections can also be used alone as anchors where placement area is limited or irregular. In an alternative embodiment, the anchors have only center feet, to allow them to be stud welded. The anchors are useful in both repair work as well as new refractory applications.

10 Claims, 4 Drawing Sheets

REFRACTORY ANCHOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to a method and system for anchoring refractory inside high temperature processing vessels, conduits and related equipment. Specifically, the invention describes a two-piece anchor suitable for spot welding or, in the alternative embodiment, stud welding.

2. Description of the Prior Art

In many chemical and petrochemical processing operations, processes occur inside vessels, conduits, cyclones, nozzle tips, air grids and related equipment having a high temperature and/or abrasive environment. To protect such equipment, a thin layer of erosion resistant refractory, usually castable concrete or plastics, is applied to the exposed surface. The common name for such protective material is simply "refractory".

Refractory commonly comes in two forms: pre-mixed and dry. In the pre-mixed form, the refractory comes in an approximately 50# 1' cube. The refractory is sliced with a straight edge into 1½" thick sections, and then pressed by hand into a support network of refractory anchors or mesh that is mounted on the surface to be protected. The refractory is further forced into the support structure for uniform distribution with a rubber-head pneumatic ramming gun, and then trowel finished flush with the support network structure.

In the dry form, the refractory is mixed in a large food-type mixer, and then applied and finished as with the pre-mixed form. After troweling of either form, the refractory is heat cured with a high temperature blower for final hardness.

The support structure provides a foundation structure to which the refractory anchors. The most common type of prior art is an interlocking honeycomb hexagonal steel grid known as "hex". This steel grid typically comes in 10'×3'×1" sheets, have 2 ⅞" openings. The sheets are held together with clinches that clip through openings in the 1" sides. The sheets are positioned against the surface to be protected, and are welded to that surface at the crotches of the mesh, typically at every other hex on every other row, for a 50% weld pattern.

Refractory is applied initially in new construction and is often replaced in repair (turnaround) jobs. In new construction and pre-turnaround jobs, the support anchors (such as hex) are usually welded on a horizontal lower surface for ease of positioning and welding. On a large vessel, this is accomplished by placing the vessel on support rollers that turn as each side is completed, such that all work is done on the floor surface of the vessel.

On a repair job, the old refractory is typically supported by honeycomb hex steel. Failure of the refractory is usually due to a localized buildup of by-products, such as coke, behind the refractory. This buildup creates pressure between the protected wall and the refractory, causing sections of the hex to break their welds away from the protected surface. The protection afforded by the refractory is then compromised, and the refractory must be replaced. To do so, the old hex section that failed is cut out on a perimeter, and the welds remaining within the failed section are broken away from the protected surface by "ribboning out" the ribbons of hex with a chipping gun or an arc rod. The failed section of refractory/hex support is then removed. The remaining stubs on the vessel (or other protected) surface are ground down, new hex structure is welded to the protected surface, and new refractory applied.

Repairing existing hex with new hex is slow and difficult, requiring highly skilled craftsmen. As noted above, the old welds must be ground down for a smooth lay-down of the new hex. The new hex must be cut such that adequate support is provided in the patch area, without an excessive amount of new and old support being contiguous, thus preventing refractory in such areas. Hex is also difficult to work with on smaller and/or less planar surfaces, such as nozzle tips, cyclones, conduits, etc.

An alternative to hex in the prior art is found in a variety of independent anchors, each having their own benefits and limitations. U.S. Pat. No. 4,711,186 issued to Chen et al. discloses a refractory anchor having a curved "X" shape. Limitations include a solid weld and lower arms that restrict refractory flow during set-up, and incompatibility with stud welding. U.S. Pat. No. 4,753,053 issued to Heard discloses refractory curl anchors having ends transverse to a flat central member, to form a "C". Limitations include the unilateral placement of the end anchoring means, which minimizes the amount of refractory where units are adjacent. In addition, the embodiments having asymmetrical structure do not afford uniform anchorage, and the one I-shaped embodiment affords poor coverage due to the transverse orientation of the end sections.

U. S. Pat. Nos. 4,479,337, 4,581,867 and 4,680,98 issued to Crowley disclose the Crowley S-anchor. Limitations include the single welding attachment point, which leads to heat induced strength failure. U.S. Pat. No. 4,660,343 issued to Raycher et al. discloses a Crowley S-anchor adapted for stud welding by cutting notches in the base of the anchor. Limitations include the requirement to affix two side plates (each being of 16 Gauge metal that is 1/16" thick) to the weld base (also 16 Gauge) to achieve a sufficient width (3/16") to arrive at a 4:1 length:width ratio (¾" length and 3/16" width).

U.S. Pat. No. 4,651,487 issued to Nishikawa discloses tubular cylinder anchors having cutouts to allow refractory to migrate around the anchor. Limitations include inherent difficulties in welding around a small circle and limited flow into the cylinders.

It would therefore be useful improvement of the prior art for an independent refractory anchor that does not have the limitations of the prior art, including those described above.

BRIEF SUMMARY OF THE INVENTION

Accordingly, the objectives of this invention are to provide, inter alia, a new and improved refractory anchor that:

is easily attached to a vessel wall;

is corrosion resistant;

can be adapted for stud welding;

allows uniform flow of refractory;

afford maximum refractory anchorage;

utilizes a symmetrical shape for uniform anchorage; and is cost efficient.

These objectives are addressed by the structure and use of the inventive refractory anchor and method of use. Other objects of the invention will become apparent from time to time throughout the specification hereinafter disclosed.

DETAILED DESCRIPTION OF THE INVENTION

The present invention is described as and in the use of refractory anchor 10.

Figure 1:
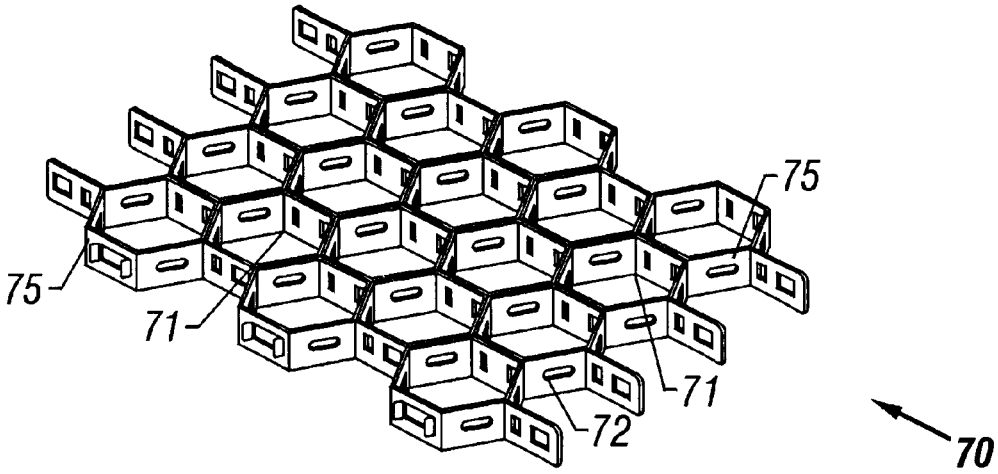
FIG. 1 (Prior Art)
FIG. 1 depicts prior art hex mesh.

The most common prior art for a refractory anchor is hex mesh 70 depicted in FIG. 1. Typically, hex mesh 70 comes in 10'×3' sheets, with a 1" depth. Hex mesh 70 is placed against the surface to be protected and then tack welded in the crotches 71. Hex mesh 70 affords good attachment to the surface, and the refractory anchors well against the sides of hex ribbons 75 and within hex voids 72. However, due to the ribbon and sheet nature of hex mesh 70, it is difficult to use on non-planar surfaces, small areas and in patchwork.

Figure 2:
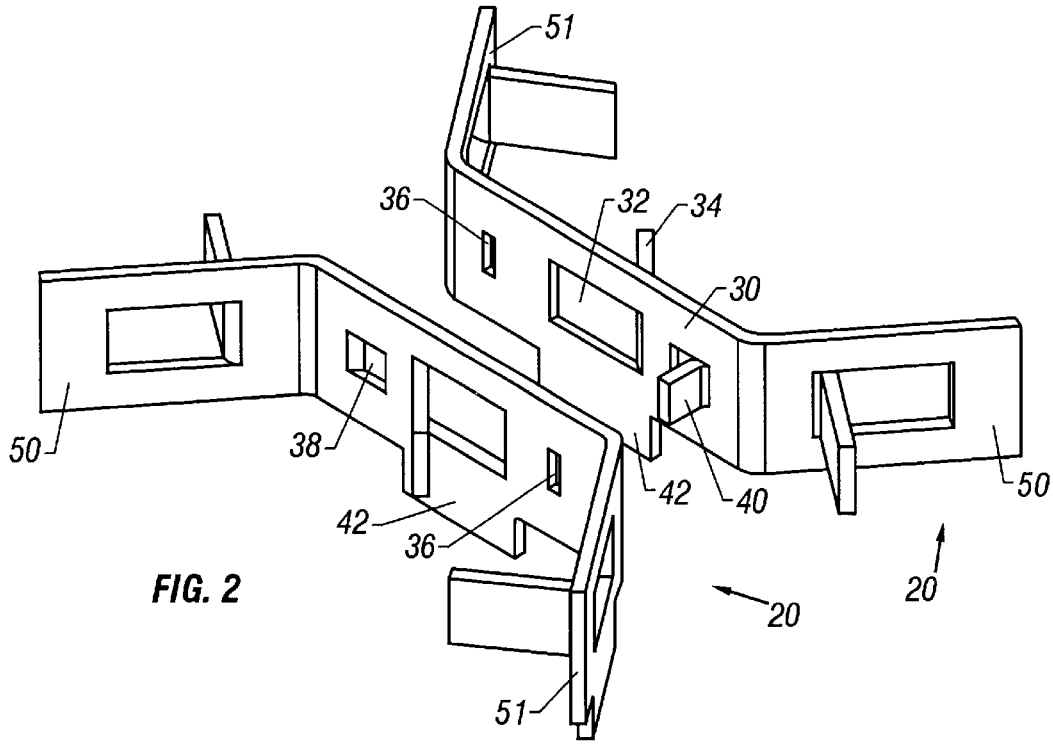
FIG. 2 depicts the separated inventive independent refractory support.
Figure 3:
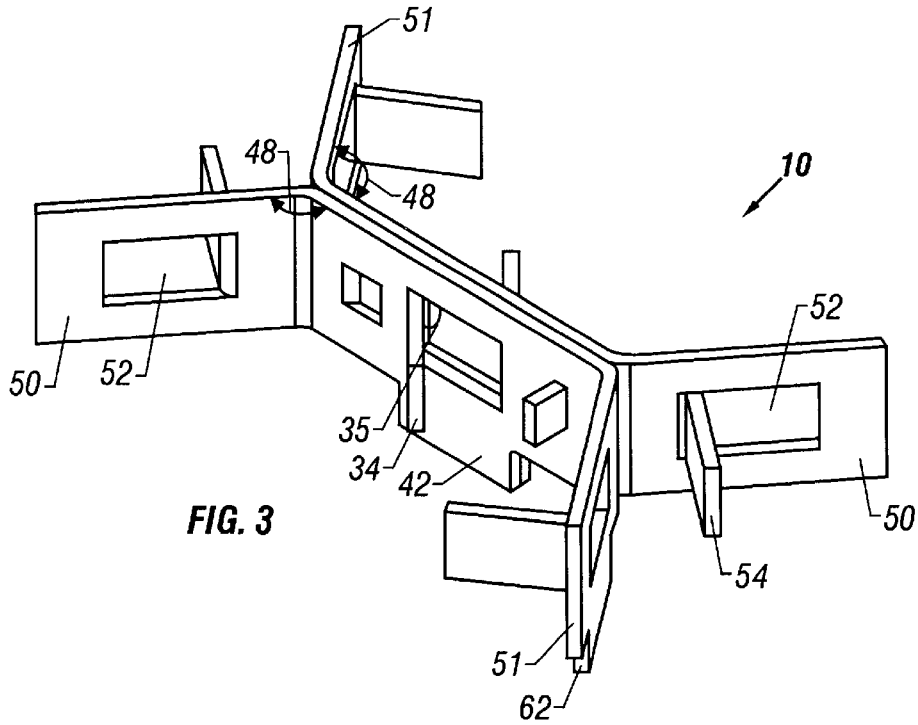
FIG. 3 depicts the joined inventive independent refractory support.

The inventive refractory anchor 10 is depicted in detached view in FIG. 2 and assembled view in FIG. 3. Each refractory anchor 10 is composed of two anchor components 20. Each anchor component 20 comprises a flat center section 30 having a first punched end section 50 at a first end of center section 30 and second punched end section 51 at a second end of center section 30. In the preferred embodiment, anchor components 20 are constructed of 14-gage metal, preferably 14-gage type 304 stainless steel. In the preferred embodiment, center section 30 has a length between 1.5" and 3.0", preferably 2.0", and a height between 0.5" and 1.5", preferably 0.75" (without center foot 42). In the preferred embodiment, first punched end section 50 and second punched end section 51 each have a length between 1" and 1.5", preferably 1.25", and a height between 0.5" and 1.5", preferably 0.75" (without end foot 62). These preferred dimensions provide optimal support of a 1" layer of refractory, a common thickness of refractory application.

In the preferred embodiment, center section 30 has at least one center anchorage void 32, and first punched end section 50 and second punched end section 51 have at least one end anchorage void 52. Center anchorage void 32 and end anchorage voids 52 are each formed in a similar manner. Center anchorage void 32 is formed when center anchorage fin 34 is punched out from center section 21. End anchorage voids 52 are formed by punching out end anchorage fins 54 from first punched end section 50 and second punched end section 51. In the preferred manufacturing process, center anchorage fin 34 and end anchorage fins 54 are punch pressed out of a flat strip of metal, and that flat strip is then bent to form first punched end section 50 and second punched end section 51. It is noted that all anchorage fins and anchorage voids may be formed by any comparable method of formation, including casting, cutting and other methods known in the art. Further, the name given to first punched end section 50 and second punched end section 51 should not be limiting to suggest that the end anchorage fin 54 can only be formed by punching.

The punch out process creating center anchorage fin 34 and end anchorage fins 54 is such that less than all edges are punched, leaving one edge of each anchorage fin attached to the main body of anchor component 20 to form a rigid hinge connection therewith. Center anchorage fin 34 is punched away from the same flat side of anchor component 20 which first punched end section 50 and second punched end section 51 are angled toward. End anchorage fin 54 from first punched end section 50 is punched away from the opposite flat side of component 20. Preferably, end anchorage fins 54 are each perpendicular to first punched end section 50 and second punched end section 51, while center anchorage fin 34 is at an acute angle 35 away from center section 30. Acute angle 35 is within the range of 35° to 50°, preferably 45°. Preferably, the dimensions of both center anchorage fin 34 and end anchorage fins 54 (and thus center anchorage void 32 and end anchorage void 52) are a length between 0.5" and 0.75", preferably 0.625", and a height between 0.25" and 0.5", preferably 0.375".

First punched end section 50 and second punched end section 51 each extend away from the opposite ends of center section 30 but in the same oblique offset direction to define obtuse angles 48, which are preferably equal. In the preferred embodiment, obtuse angles 48 are in the range of 100°–140°, preferably 127°. Obtuse angles 48 in this range create a shape similar to a regular hexagon's interior angles of 120°, to assist in matching the remaining prior hex mesh 70 in a patch. Further, obtuse angles 48 provide optimal uniformity of displacement between other refractory anchors 10, thus providing uniform anchorage for the refractory while avoiding anchorage being too contiguous, and thus creating areas of reduced refractory due to the displacement by the anchors.

The center sections 30 of a first anchor component 20 and a second anchor component 20 mate together such that the center feet 42 of each component 20 are aligned and adjacent, and the center anchorage fins 34 are oriented in opposing directions. Further, first punched end section 50 of the first anchor component 20 and second punched end section 51 of the second anchor component 20 are aligned adjacent but directed away from each other, as depicted in FIG. 3. This mating creates an elongated X-shape, which provides optimal anchorage of the refractory due to the uniform bilateral support provided by the opposing end sections.

Figure 4:
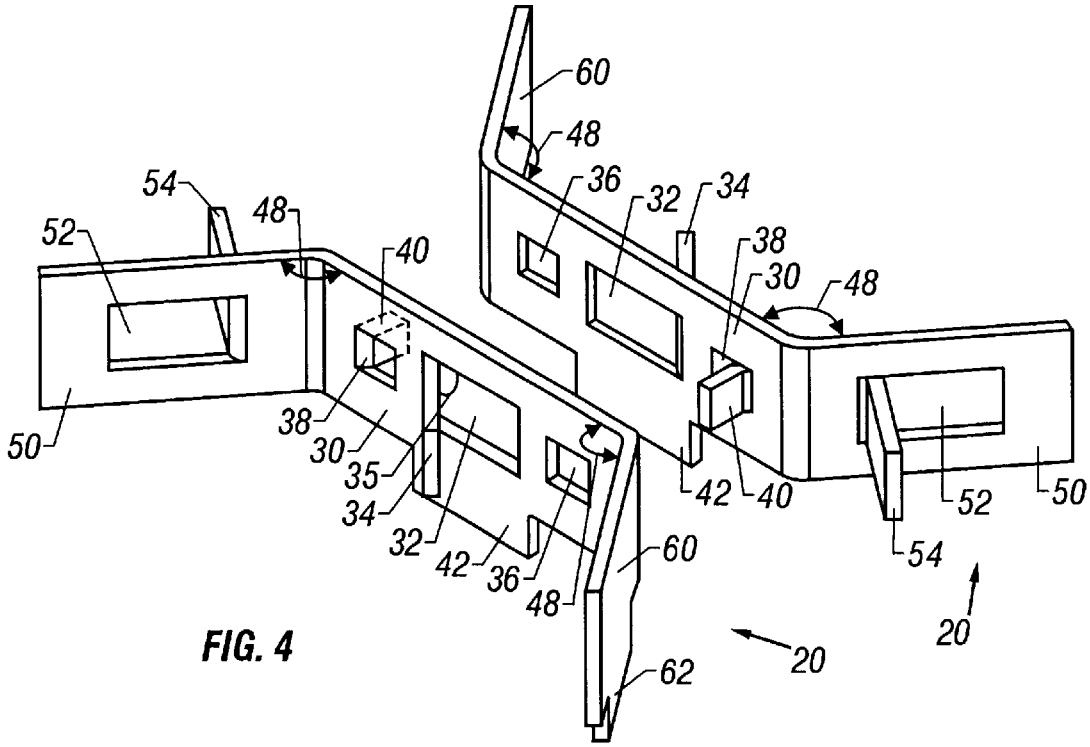
FIG. 4 depicts an alternative embodiment of the separated inventive independent refractory support.
Figure 5:
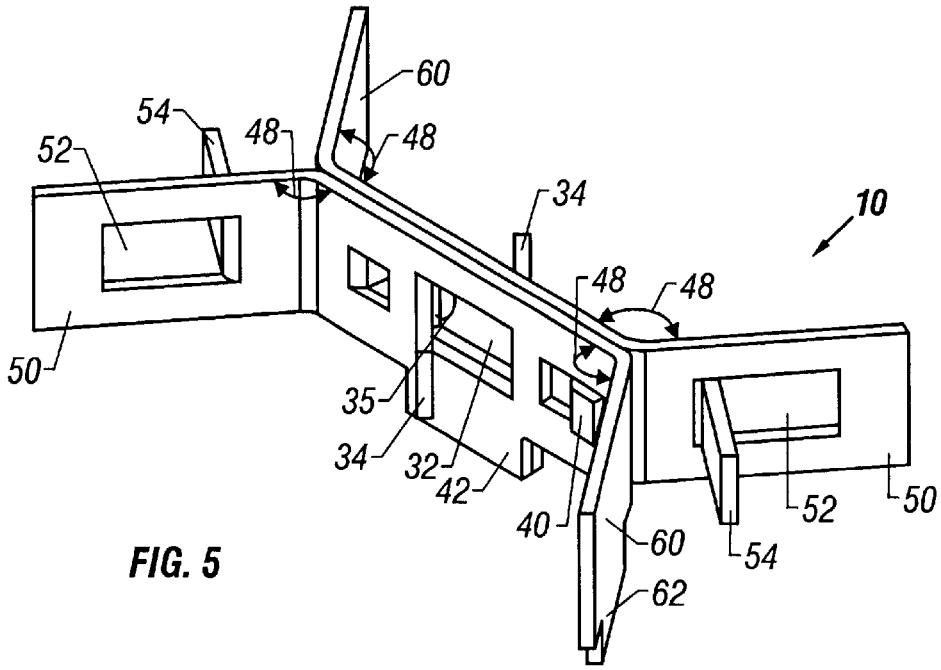
FIG. 5 depicts an alternative embodiment of the joined inventive independent refractory support.
Figure 7:
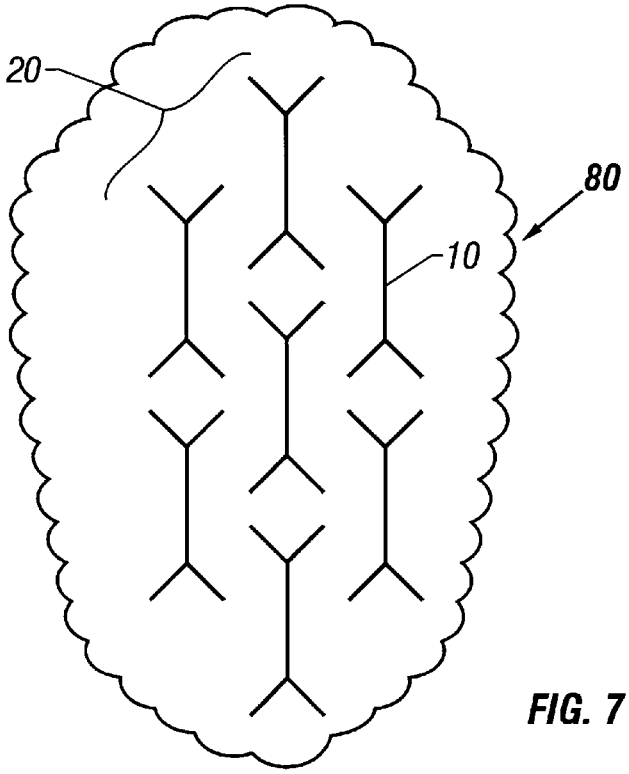
FIG. 7 depicts a preferred embodiment of placement of the inventive support.
Figure 8:
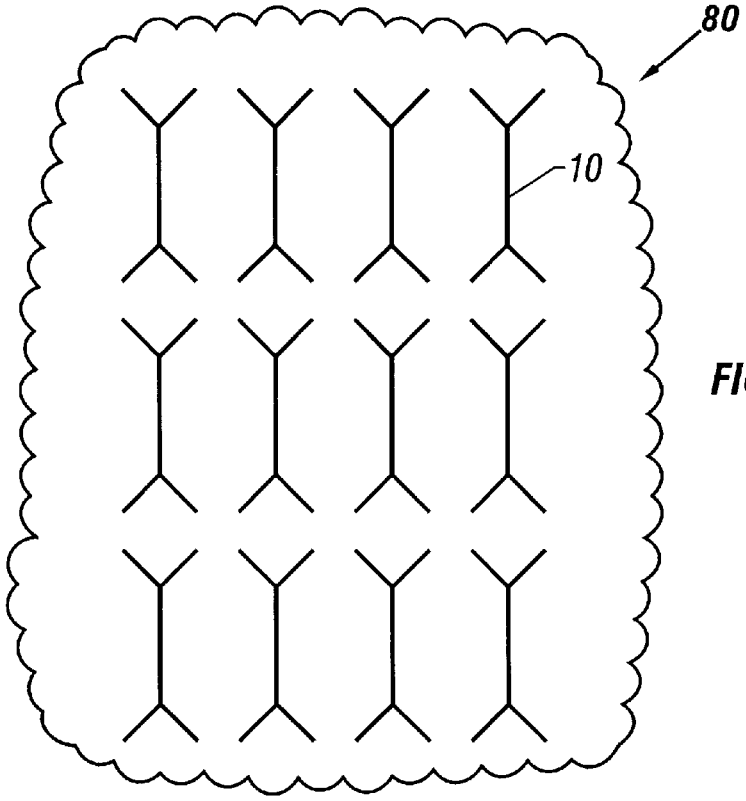
FIG. 8 depicts an alternate preferred embodiment of placement of the inventive support.

In the alternative embodiment shown in FIGS. 4 and 5, refractory anchor 10 has a solid end section 60 instead of a second punched end section 51. This difference is the result of not punching an end anchorage fin 54 out of solid end section 60, leaving solid end section 60 solid. In this embodiment, the orientation of punched end sections 50 and solid end sections 60 on obtuse angle 48 assists in the controlled downward flow of refractory when on a vertical surface. These end sections allow refractory to migrate downward, while still having adequate surface tension against their sides to retain the refractory. By orienting a first punched end section 50 adjacent to a solid end section 60, uniform flow is still assisted (by the presence of end anchorage void 52) while vertical support is enhanced (by solid end section 60).

Refractory anchor 10 is typically attached to the surface to be protected by welding. Welding feet are provided to allow refractory flow below refractory anchor 10, providing maximum refractory flow and thus protection. In the preferred embodiment, anchor component 20 has center foot 42 centered on and aligned with the bottom edge of center section 30, and end foot 62 centered on and aligned with the bottom edge of second punched end section 51 (or solid end section 60). When two anchor components 20 are mated as described above, center feet 42 are contiguous to provide a doublestrength welding footprint.

In an alternative embodiment, second punched end section 51 (or solid end section 60) does not have an end foot 62, thus leaving center foot 42 as the only foot for welding. This embodiment is preferred for stud welding, wherein refractory anchor 10 or anchor component 20 is inserted into an electric stud welding chuck.

Operation

During chemical processing operations, by-products can accumulate behind the refractory. When by-products such as coke build up behind the refractory/hex mesh 70 composition, localized sections break out when the crotch 71 welds fail. As depicted in FIG. 4, the damaged refractory is removed from damaged refractory area 80. Hex ribbon 75 is un-clinched from the rest of hex mesh 70, and the remaining welds attaching hex ribbons 75 are broken using a chipping tool or an arc rod. After removing the old refractory residue from the surface to be protected, areas on the surface are wire-brushed to present a clean welding surface.

Refractory anchor 10 is first assembled from two units of anchor component 20. Center sections 30 are mated together, such that center clinch 40 of each anchor component 20 inserts through the corresponding clinch receiving void 36, as depicted in FIG. 2. After anchor components 20 mate such that center sections 30 of each anchor component 20 are flush, center clinches 40 are bent to the side using a standard clinching tool, to secure the two anchor components 20 into a single refractory anchor 10, as seen in FIG. 3.

Refractory anchors 10 are then welded on the clean brushed areas of the surface to be protected using standard welding techniques known in the art. Each refractory anchor 10 is manually positioned such that the doubled center feet 42 and both end feet 62 are in contact with surface to be protected, and each of the three feet are then welded to the surface.

In the alternative, refractory anchor 10 can be constructed of anchor components 20 that are missing end feet 62, such that the only welding feet are center feet 42, and thus can be stud welded. Preferably, center feet 42 are tapered down in this embodiment, to maximize metal arc flow in the stud welding process. This embodiment of refractory anchor 10 is clamped into a stud welding chuck, and then welded on a cleaned area of the surface to be protected.

Anchor components 20 can also be used alone as an anchor for refractory. As depicted in FIG. 5, anchor components 20 can be positioned in interim areas between refractory anchors 10 and existing hex ribbons 75, to provide maximum anchorage for the new refractory. Anchor components 20 can be welded at their center foot 42 and end foot 62, or alternatively can be stud welded by using a modified anchor component 20 having no end foot 62 and a (preferably) tapered center foot 42.

Figure 6:
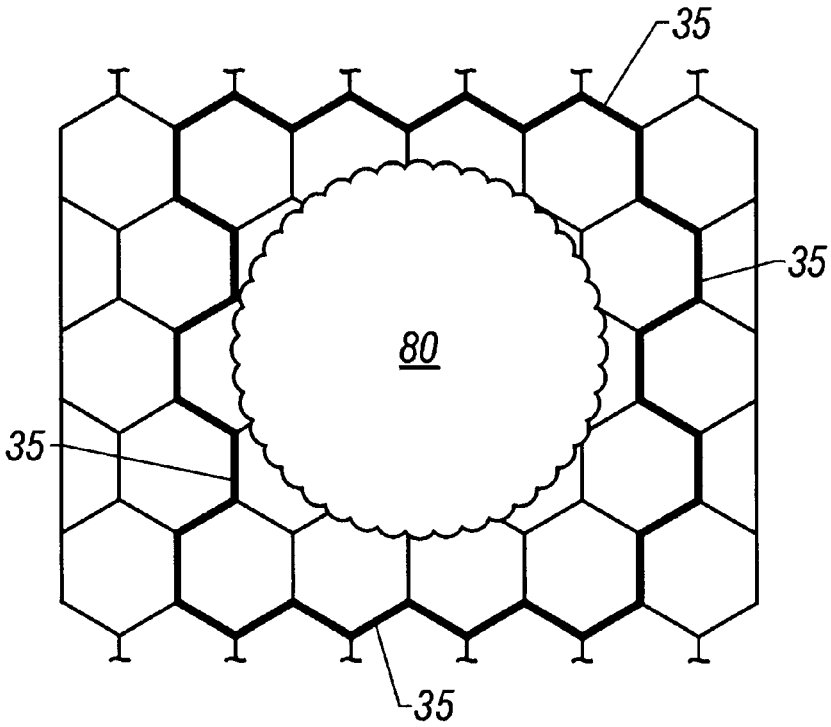
FIG. 6 depicts a typical area having hex mesh in need of repair.

The user determines the positioning of each refractory anchor 10. In a critical situation where maximum anchorage of the refractory is required, the preferred layout of refractory anchors 10 is shown in FIG. 5. The offset staggered layout affords maximum uniform distribution of the refractory, with minimal areas of proximate refractory anchors 10, and thus maximum refractory area coverage. In non-critical areas where such "dead spots" having minimal refractory are not as important, the alternative layout shown in FIG. 6 may be used.

Refractory commonly comes in two forms: pre-mixed and dry. In the pre-mixed form, the refractory comes in an approximately 50#1' cube. The refractory is sliced with a straight edge into 1½" thick sections, and then pressed by hand into the support network of refractory anchors 10 mounted on the surface to be protected. The refractory is further forced into the support structure for uniform distribution with a rubber-head pneumatic ramming gun, and then trowel finished flush with the support network structure.

The initial application and subsequent pneumatic forcing of the refractory forces the refractory to flow under, through and around the refractory anchors 10. Flow is afforded under the welded refractory anchors 10 by the raised orientation provided by center feet 42 and end feet 62. Flow is afforded through refractory anchors 10 by openings provided by center anchorage voids 32, clinch receiving voids 36, clinch voids 28 and end anchorage voids 52. Anchorage between the refractory and refractory anchors 10 is maximized by the broad bilateral surface areas provided by center sections 30, first punched end sections 50, second punched end section 51 (or solid end sections 60), center anchorage fins 34 and end anchorage fins 54.

In the dry form, the refractory is mixed in a large food-type mixer, and then applied and finished as with the pre-mixed form.

After applying the refractory as described by hand and ramming, the refractory is troweled smooth to a thickness equal to or slightly greater than the combined height (central height plus feet height). The refractory is then heat cured with a high temperature blower for final hardness.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A refractory anchor comprising:

a first anchor component and a second anchor component;

each said anchor component comprising a center section, a first punched end section and a second end section;

said center section being flat and having a first end and a second end;

said first punched end section being flat, aligned with and connected to said center section first end, and obliquely oriented to said center section;

said second end section being flat, aligned with and connected to said center section second end, and obliquely oriented to said center section in the same direction as said first punched end section;

said center section of said first anchor component and said center section of said second anchor component being mated contiguously such that said first punched end section of said first anchor component and said second end section of said second anchor component are oriented in opposing directions;

said first punched end section of said second anchor component and said second end section of said first anchor component are oriented in opposing directions;

said center section of said first anchor component and said center section of said second component each having an outwardly extending center clinch and a clinch receiving void; and said first anchor component mated to said second anchor component with each center clinch being clinched together with a respective said clinch receiving void.

2. The refractory anchor as in claim 1, further comprising:

each said anchor component comprising an attachment means;

said attachment means comprising at least one center foot and at least one end foot;

said at least line center foot being aligned with and attached to a lower edge of said center section;

said at least one end foot being aligned with and attached to a lower edge of said second end section.

3. The refractory anchor as in claim 1, further comprising:

said center section comprising an attachment means;

said attachment means comprising at least one center foot; and said at least one center foot being aligned with and attached to a lower edge of said center section.

4. The refractory anchor as in claim 1, further comprising:

at least one void in said center section; and at least one void in each said punched end section.

5. The refractory anchor as in claim 1, wherein said second end section being a second punched end section.

6. The refractory anchor as in claim 1, wherein said second end section being a solid end section.

7. The refractory anchor as in claim 4, further comprising:

at least one anchorage fin obliquely oriented away from said center section; and at least one anchorage fin transversely oriented away from said punched end section.

8. The method of anchoring refractory, said method comprising:

securing an array of refractory anchors to a surface;

applying manually refractory around said array of refractory anchors;

ramming said refractory around said refractory anchors;

troweling said refractory level with said refractory anchors;

curing said refractory with a heat source;

said array of refractory anchors comprising a plurality of refractory anchors and a plurality of individual anchor components;

each of said refractory anchors comprising a first said anchor component and a second said anchor component;

each said anchor component comprising a center section, a first punched end section and a second end section;

said center section being flat and having a first end and a second end;

said first punched end section being flat, aligned with and connected to said center section first end, and obliquely oriented to said center section;

said second end section being flat, aligned with and connected to said center section second end, and obliquely oriented to said center section in the same direction as said punch end section;

said center section of said first anchor component and said center section of said second anchor component being mated such that said punched end section of said first anchor component and said second end section of said second anchor component are aligned in opposing directions;

said punched end section of said second anchor component and said second end section of said first anchor component are aligned in opposing directions; and said center section of said first anchor component and said center section of said second component each having an outwardly extending center clinch and a clinch receiving void; and said first anchor component mated to said second anchor component with each center clinch being clinched together with a respective said clinch receiving void.

9. The method as in claim 8, wherein said second end section being a second punched end section.

10. The method as in claim 8, wherein said second end section being a solid end section.

* * * * *